US005186135A

United States Patent [19]

Kovach

[11] Patent Number: 5,186,135

[45] Date of Patent: Feb. 16, 1993

[54] VALVE STEM TOPOGRAPHICAL OPTIMIZATION PROCESS

[75] Inventor: Joseph A. Kovach, Aurora, Ohio

[73] Assignee: Eaton Corporation, Cleveland, Ohio

[21] Appl. No.: 817,171

[22] Filed: Jan. 6, 1992

[51] Int. Cl.[5] ..... F01L 3/20

[52] U.S. Cl. ..... 123/188.3; 123/188.9

[58] Field of Search ..... 123/188.3, 188.9

[56] References Cited

U.S. PATENT DOCUMENTS

| | | | |
|---|---|---|---|
| 2,857,896 | 6/1957 | Schnepel | 123/188.9 |
| 4,928,645 | 5/1990 | Berneburg | 123/188.3 |
| 5,076,866 | 12/1991 | Koike et al. | 123/188.3 |
| 5,094,200 | 3/1992 | Fontichiaro | 123/188.3 |

*Primary Examiner*—E. Rollins Cross
*Assistant Examiner*—Erick Solis
*Attorney, Agent, or Firm*—A. E. Chrow

[57] ABSTRACT

Processes are provided that in one embodiment provide scribe or scratch marks (16) in the outer surface of an internal combustion engine valve stem (12) that are oriented at an acute angle (alpha) to the central longitudinal axis ("C") of valve stem (12) to promote stress planes that reduce the amount of stress arising in valve stem (12) from bending and reciprocating tensile forces "F" acting thereupon during operation of the engine. In another embodiment two sets of such scribe or scratch marks (26 and (28) are produced that intersect each other to provide a cross-hatch pattern and in yet another embodiment circumferentially spaced scribe or scratch marks (40) are produced in the outer surface of valve stem (36) that are substanially parallel to axis "C" and effective to reduce surface area engagable with a surrounding surface (60) of an insert (58) through which valve stem recirprocates during operation of the engine and to enable maintenance of an elastohydrodynamic lubrication film therebetween.

3 Claims, 3 Drawing Sheets

VALVE STEM TOPOGRAPHICAL OPTIMIZATION PROCESS

INTRODUCTION

This invention relates generally to a process for optimizing the topography of the outer surface of an engine valve stem and more particularly to a process whereby the topography is optimized by providing scratch or scribe marks that are oriented at an acute angle to the central longitudinal axis of the stem and are effective to enable a elastohydrodynamic lubrication (EHL) film to be maintained between the stem and a surrounding guide surface through which the stem reciprocates and to promote stress planes that are effective to lessen tensile and bending stress created by bending and reciprocating tensile forces acting upon the valve stem during operation of the engine and also to another embodiment of particular value for ceramic valves where the scratches or scribe marks are oriented in a direction substantially parallel to the stem's longitudinal axis to minimize orientation of stress risen across the axis and singularly effective to enable an elastohydrodynamic lubrication (EHL) film to be maintained between the stem and the surrounding guide surface through which the stem reciprocates.

BACKGROUND OF THE INVENTION

Internal combustion engine valve stems are subjected to bending and reciprocating tensile forces in a direction substantially parallel to the central longitudinal axis of the stem during operation of the engine.

The stress arising from the bending reciprocating tensile forces is generally disposed along a plane in the body of the stem that is perpendicular to the longitudinal axis of the valve stem, and is thus defined as $$S(\text{Stress} = \frac{F\,(\text{Force})}{A\,(\text{Area})}$$

where the area is the area of the stem perpendicular to the longitudinal axis.

The stem of an engine valve made from metal alloys are apt to warp when exposed to heat treating schedules due to the substantial difference in configuration and mass between the head and stem of the valve. Generally, the warped stems are straightened by application of a transverse force thereagainst while in a heated condition afterwhich the stem's outer surface is ground with a grinding tool whose rotational axis is oriented substantially parallel to the longitudinal axis of the stem which results in circumferential scratch or scribe marks oriented at 90° to the stem's longitudinal axis. Such circumferential scratch or scribe marks promote stress risers that circumscribe and define stress planes that are perpendicular to the stem's longitudinal axis arising from bending and reciprocating tensile forces acting upon the stem during operation of the engine which results in maximum stress since the stress plane area is at its minimum when perpendicular to the stem's longitudinal axis.

Today's increasing use of ceramic engine valves such as those made from silicon nitride pose an even greater problem since their stems are also apt to warp during heat treating but characteristically are unable to be straightened since ceramic characteristically posses a low transverse rupture modulus and would tend to fracture upon application of a transverse straightening force. Accordingly, it has heretofor been the practice to circumferentially grind warped ceramic valve stems to straighten them which again results in stress risers that are generally orthogonal to the stem's longitudinal axis and result in the highest stress arising in the stem due to their having the smallest area as previously described for metal stems.

In addition to the problem of creating stress risers, such circumferential scratch or scribe marks are apt to collect debris such as chafe galling created as a product of frictional engagement between the stem and surrounding guide surface through which the stem reciprocates during operation of the engine.

The inclusion of such debris such as galling chafe in circumferential scratches or scribe marks in the stem's outer surface diminishes the ability to create and maintain an elastohydrodynamic lubrication (EHL) film between the stem and surrounding guide wall surface which can greatly reduce the working life of the valve. As described by Dr. Andrew Jackson in an article entitled "ELASTOHYDRODYNAMIC LUBRICATION (EHL)," beginning on page 833 in "Lubrication Engineering", Oct. 1991; EHL films are fluid films that are very thin, characteristically less than a micrometer in thickness that have high viscosity and prevent surface to surface contact.

In many instances, it has also been common practice to coat the valve stem with a low friction or high wear resistant material such as chrome to lessen friction between the stem and a valve guide through which the stem reciprocates during operation of the engine. Today however, the environmental and toxilogical problems associated with chrome are well recognized and it is to the advantage in the valve industry to lessen or eliminate its use.

The process of present invention addresses both the problems of stress and friction reduction heretofor described which is of particular advantage because of the present trend to higher speed and higher operating temperature engines.

The process of the present invention provides a valve stem finishing process that produces a round and extremely straight valve stem with an advantageous "by-product" of preferentially orienting marks or scratches on the surface of the stem that can maximize EHL film establishment and maintenance while minimizing stress concentration.

SUMMARY OF THE INVENTION

Accordingly, it is an object of this invention to provide a process effective to lessen stress on an internal combustion engine valve stem and to enable maintenance of an elastohydrodynamic lubrication film between the stem and the surrounding surface of a guide through which the stem reciprocates during operation of the engine.

It is another object of this invention to provide a process effective to lessen friction between an internal combustion engine valve and a guide through which the stem reciprocates during operation of the engine.

It is still a further object of this invention to provide an internal combustion engine valve that has been provided with scratch or scribe marks on its stem operative to create stress planes effective to lessen stress upon the stem without inhibiting maintenance of an elastohydrodynamic lubrication film between the stem and a guide through which the stem reciprocates during operation of the engine.

DESCRIPTION OF SOME PREFERRED EMBODIMENTS

Figure 1A:
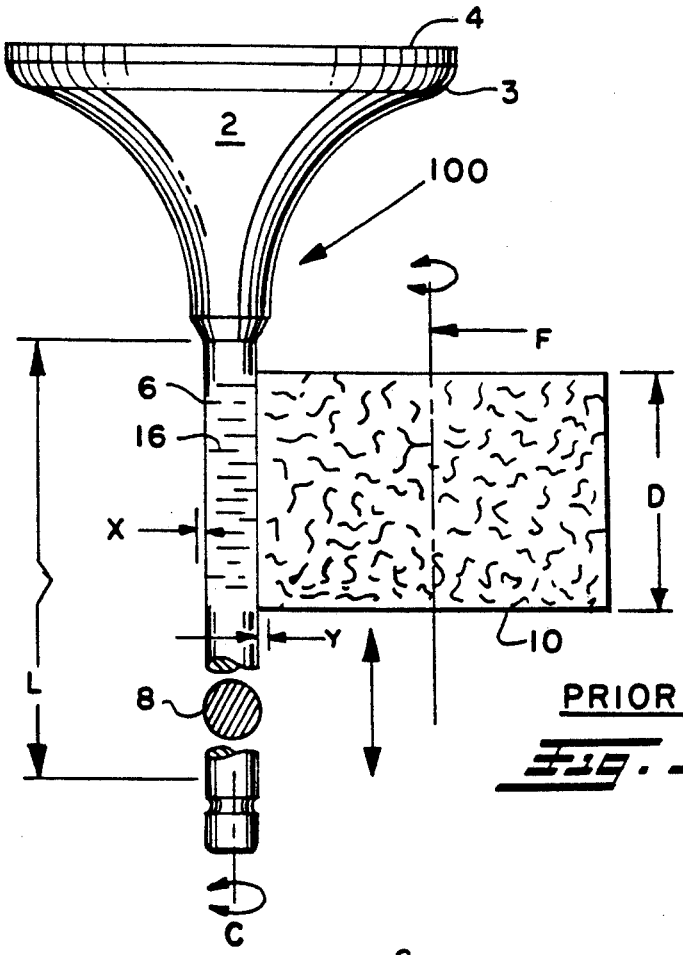
PRIOR ART Fig. 1A
FIG. 1A is a partial top elevation view of a prior art method for grinding a warped stem of an internal combustion engine valve 100.

A prior art process of grinding a warped valve stem 6 of an internal combustion engine valve 100 is shown in FIG. 1A. Valve 100 has a head 2 having a combustion face 4 that is exposed to the engine's combustion chamber. Head 2 has an annular seat face 3 that seats upon an insert disposed in the engine block about the valve head. Face 4, seat face 3 and the insert feature highly specialized metallurgical characteristics and heat treatment histories tailored to provide them with the strength, abrasion, corrosion and high temperature resistance required for internal combustion engine operation as is well known to those skilled in engine valve metallurgical art.

Because of substantial differences between the mass and configuration of head 2 and stem 6, stem 6 may become warped during heat treatment of the valve as illustrated by its curved configuration that deviates from being straight by the transverse distance referenced by "X" as previously described, it has heretofor been common practice in the past to heat straighten and then circumferentially grind metal valve stems such as stem 6, commonly on a centerless grinder, with a grinding wheel 10 that historically has been oriented in a direction transverse to central longitudinal axis "C" of valve 100.

Grinding wheel 10 is urged against stem 6 by a predetermined force "F" so as to dress an amount "Y" of material from stem 6 for a selected axial length "L" to insure sufficient straightening which, in some cases, may require having to remove as much as 0.020 inch from its diameter. Grinding wheel 10 commonly has a width "D" that is about the same as length "L" but, in instances where its width is narrower than "L", it is caused to traverse along stem 6 as shown by the vertical arrows.

Figure 1B:
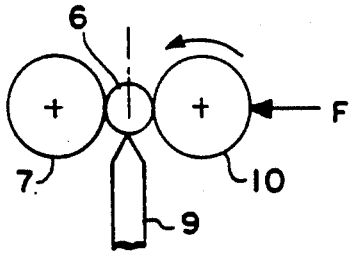
PRIOR ART Fig. 1B
FIG. 1B is a partial end view of a prior art centerless grinding arrangement for grinding an engine valve stem 10.

The prior art process of centerless grinding is best shown in FIG. 1B where stem 6 is positioned on a fulcrum in the form of a work rest blade 9 between a backup wheel 7 and grinding wheel 10 which is urged against stem 6 by a predetermined force "F" and rotated in the direction shown by the arrows.

Although stem 6 may in the warped state have a generally circular cross section such as referenced by numeral 8, the dressing process may dress only the high or convex side of the curved stem resulting in a cross section after dressing that may not be perfectly round.

The above described prior art grinding process imparts circumferential scribe or scratch marks in the outer surface of the valve stem that are oriented in a direction substantially transverse to axis "C". Such scribe lines or scratch marks are prone to promote stress planes having a generally circular configuration having the smallest area promoting a stress plane for stem 6 resulting in the highest stress concentration since it is substantially perpendicular to the reciprocating forces to which valve 100 is subjected to during operation of the engine as well as providing a depository for galled material that is apt to disrupt creation and/or maintenance of an EHL film as previously described.

It is thus highly undesirable to produce scribe or scratch marks on the valve stem that are transverse to axis "C" for they may maximize stress created by the reciprocating forces thereagainst during engine operation which is of particular concern for valves made from ceramic materials such as silicon nitride that characteristically possess poor tensile characteristics compared to steel alloys commonly employed in internal combustion engine valves as previously described and whose stem, in contrast to metal stems, require grinding for straightening since they would be susceptible to fracture when subjected to a transverse force during a conventional heat straightening process.

Figure 2A:
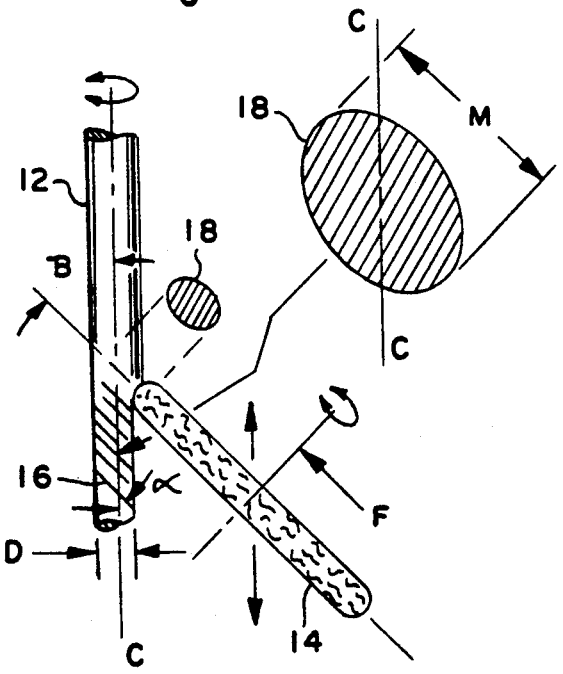
FIG. 2A is a partial top elevation view of an embodiment of the process of the invention using a single grinding wheel 14.

In FIG. 2A, a scribing tool in the form of a grinding wheel 14 is urged by a selected force "F" against valve stem 12 at an acute angle beta with central longitudinal axis "C" such that the scribe or scratch marks 16 produced thereby are oriented at an acute angle alpha ($\alpha$) with axis "C" which may or may not be the same as angle beta ($\beta$) depending upon the particular scribing or scratching characteristics of wheel 14.

As shown in FIGS. 1A and 2A, scribe or scratch marks 16 may not be continuous about the periphery of the valve stem and would be more prone to be so were the stem substantially straight prior to grinding rather than warped (commonly the case for ceramic valves) for the process of the invention is not limited to the latter but may be employed on valve stems that do not require straightening and are substantially straight to begin with (commonly the case for metal valves).

The grinding of stem 12 by wheel 14 as shown in FIG. 2A dresses stem 12 down to provide a resultant diameter "D" transverse to axis "C" that may not be a true diameter since the cross section of stem 12 may not be a true circle as previously described. The elliptical plane portended by scribe or scratch marks 16 is referenced by numeral 18 and is also shown enlarged in FIG. 2A for illustrative purposes. Plane 18 is characteristically defined by scribe or scribe marks 16 oriented at an acute angle alpha with axis "C" such that, when rotated 90° into the viewer's plane of view, has a generally elliptical configuration having its major axis referenced by the letter "M".

Figure 2B:
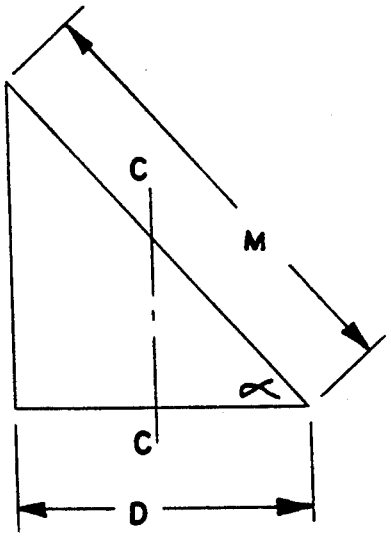
FIG. 2B is a schematic diagram showing the angular and length relationship between the valve stem diameter and the major axis of the stress plane resulting from scribe marks 16 in FIG. 2A.

The relationship between diameter "D" and axis "M" is shown in FIG. 2B were $M = D/\cos \alpha$. Thus, by scribing or scratching marks in the outer surface of stem 12 that are oriented at an acute angle with axis "C", the resultant stress plane takes on a generally elliptical configuration whose area is larger than that of the resultant transverse cross-section through stem 12 and thus reduces the stress level on stem 12 produced by bending and reciprocating longitudinal tensile forces exerted upon stem 12 during operation of the engine while minimizing galling tendencies and promoting maintainence of an EHL film between stem 12 and the surrounding surface of a guide in which stem 12 reciprocates.

A variety of relative movements may be employed in dressing stem 12 of FIG. 2A such as where stem 12 remains stationary while rotary grinding wheel 14 rotates as it moves or traverses axially along stem 12 as shown by the arrows or where stem 12 rotates while grinding wheel 14 traverses axially along stem 12.

Although in some instances it may be desirable to keep the scribing tool stationary while traversing the valve stem axially with or without rotation of the stem as the case may be, in most instances the valve stem's movement will be limited to rotation as the scribing tool moves axially therealong.

Figure 3:
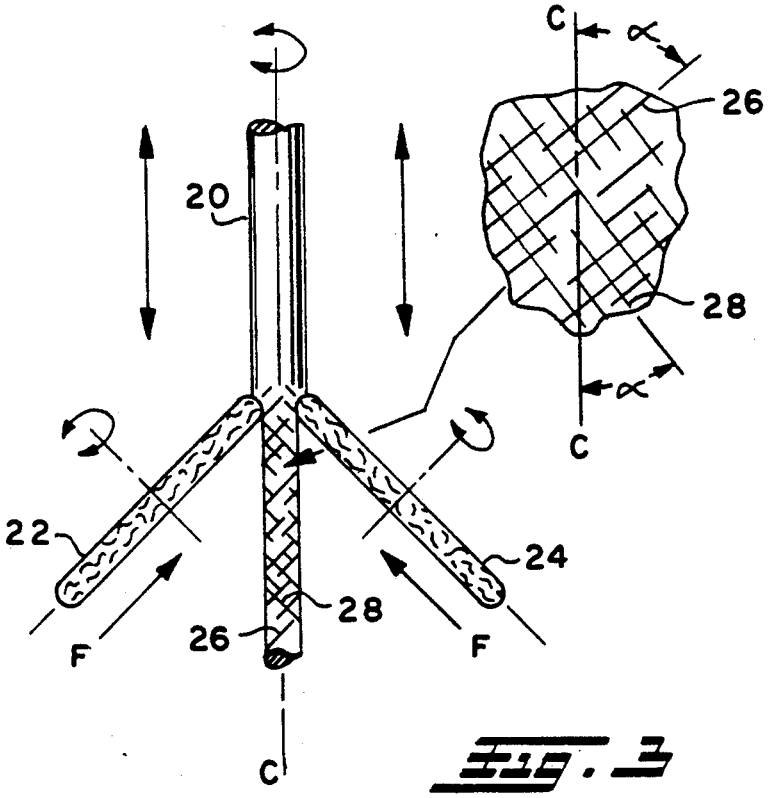
FIG. 3 is a partial top elevation view of an embodiment of the process of the invention using a pair of grinding wheels 22 and 24.

FIG. 3 illustrates that more than one scribing tool such as a pair of opposed rotary grinding wheels 22 and 24 may be employed to impart intersecting scribe or scratch marks on the outer surface of valve stem 20 to provide a cross-hatch type pattern on the outer surface of section 12, while relieving grinding bending loads and increasing material removal rates. Although, as shown in the enlarged section, scribe marks 26 and 28 preferably both intersect axis "C" at the same acute angle alpha, such is not an absolute requirement as long as the angle is acute as previously described. Preferably acute angle alpha is from about 30° to about 50° whether or not cross-hatching is involved. In the event cross-hatching is involved, then preferably each set of marks intersect each other at an included angle therebetween of about 80° to about 100°.

A variety of relative movements may be employed to produce the cross-hatch pattern shown in FIG. 3 such as where stem 20 remains stationary while rotary grinding wheels 22 and 24 rotate as they are urged against stem 20 with respective predetermined forces "F" and traverse or move axially along stem 20 as shown by the arrows. Alternatively stem 20 may itself be rotating while the above described movement of rotary grinding wheels 22 and 24 are underway.

Figure 4:
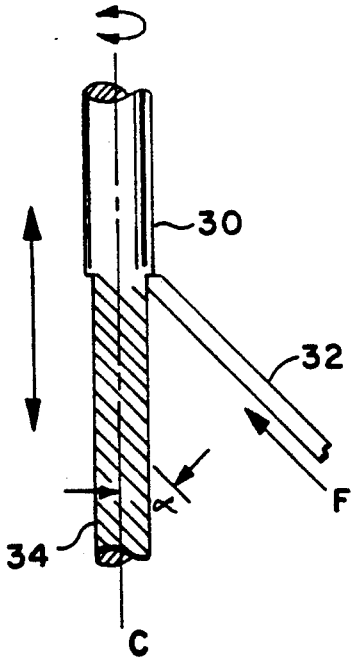
FIG. 4 is a partial top elevation view of an embodiment of the process of the invention using a pointed scribing tool 32.

FIG. 4 shows a process of the invention in which a pointed scribing tool 32 is being urged against valve stem 30 by a selected force "F" to produce scribe or scratch marks 34 that are oriented at an acute angle alpha with axis "C". The embodiment illustrates that the process of the invention is not limited to the use of rotary grinding but may employ other means for producing scribing or scratch marks on the valve stem such as pointed scribing tool 32 shown in FIG. 4.

Figure 5:
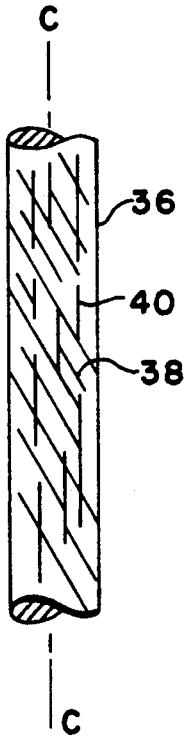
FIG. 5 is a partial top elevation view of a valve stem 36 having both longitudinal scribe or scratch marks 40 and angular scribe or scratch marks 38 on the outer surface.

FIG. 5 shows one pattern produced by scribing tool(s) in the outer surface of valve stem 36 in which a set of circumferentially spaced scribe or scratch marks 40 are substantially parallel with axis "C" and intersect a set of scribe or scratch marks 38 that are oriented at an acute angle with axis "C".

Figure 6:
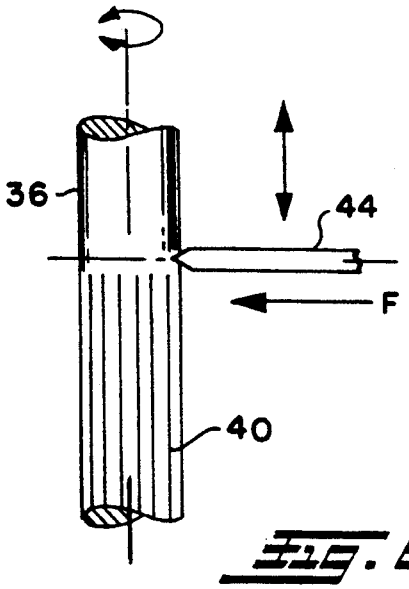
FIG. 6 is a partial top elevation view of a valve stem 42 having longitudinal scribe or scratch marks 46 created by a pointed scribing tool 44.

FIG. 6 shows that the circumferentially spaced scribe or scratch marks 40 of FIG. 5 may be made by a pointed scribing tool 44 that is urged against stem 36 by a predetermined force "F" and then traverses axially in one direction the selected length therealong until it reaches the end of the length at which point stem 36 rotates a predetermined angular amount and tool 44 then traverses axially along stem 36 in the opposite direction for the selected length therealong.

Figure 7:
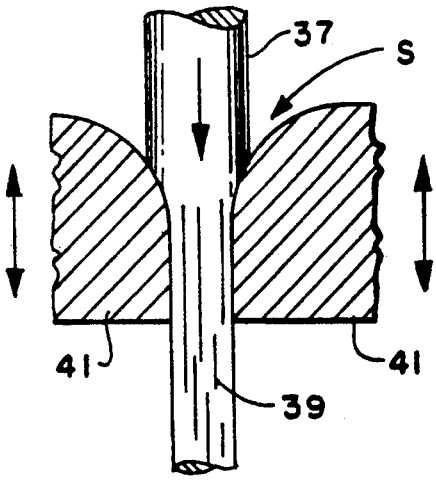
FIG. 7 is a partial cross-sectional side elevation view of a reciprocating die 41 being used to impart longitudinal scribe a scratch marks 39 on a valve stem 37.

FIG. 7 shows longitudinal scribe or scratch marks produced in the outer surface of valve stem 37 by a die 41 through which stem 37 is drawn while preferably being exposed to an abrasive slurry "S" such as a diamond slurry. Die 41 may for example be diamond coated and may reciprocate to enhance the marking of stem 37. Additionally, one or both of stem 37 and die 41 may rotate so as to impart scribe or scratch marks on stem 37 that are oriented at an acute angle to its longitudinal axis.

Figure 8:
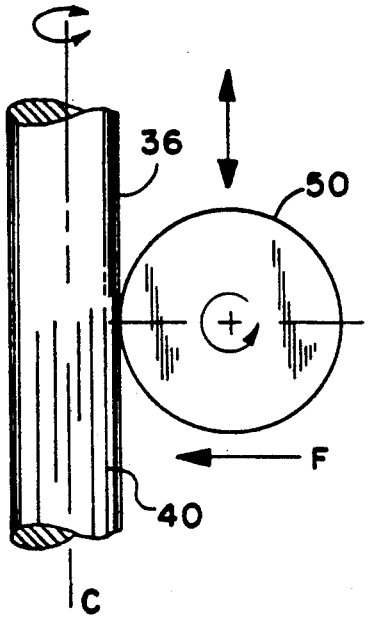
FIG. 8 shows a partial top elevation view of a valve stem 48 having scribe or scratch marks 52 created by grinding wheel 50.

FIG. 8 shows an embodiment in which the circumferentially spaced scribe or scratch marks 40 shown in FIG. 4 may be produced by a rotary grinding tool 50 that is urged against stem 36 by a selected force "F" while moving axially in one direction therealong to the end of the length whereupon stem 36 rotates a predetermined angular amount at which wheel 50 then traverses axially in the opposite direction along stem 36 in what can be described as an indexing machine operation.

Figure 9:
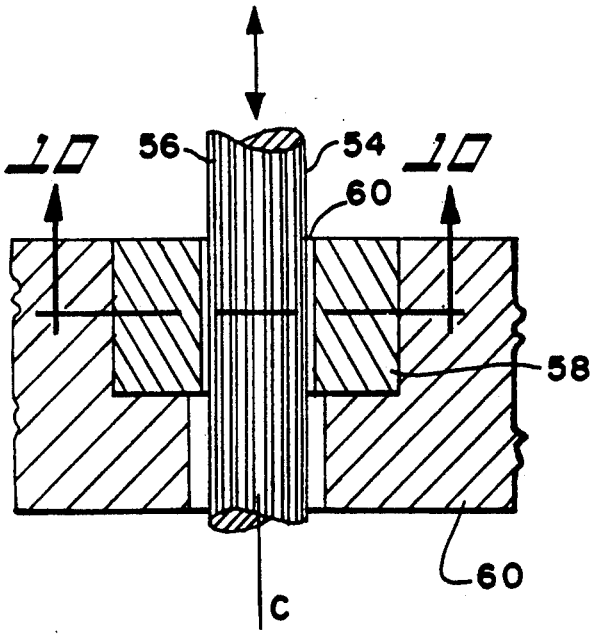
FIG. 9 is a partial cross-sectional side elevation view of a valve stem reciprocally moving through a guide 58.
Figure 10:
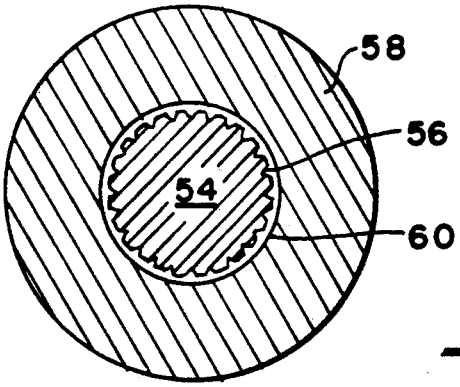
FIG. 10 is a cross-section of the stem 56 and guide 58 taken along view line 9—9 in FIG. 9.

FIGS. 9 and 10 show where a valve stem 54 having circumferentially spaced scribe or scratch marks 56 that are substantially parallel to axis "C" can be used to particular advantage in reducing the amount of outer surface area of stem 54 engagable with a surrounding surface 60 of a guide 58 in which stem 54 reciprocates during operation of the engine and thus effectively reduce the amount of friction material coating such as chrome heretofor employed to reduce friction between stem 54 and annular surface 60 as well as effectively minimize any galling tendency or deposit build up in the scribe or scratch marks which in turn promotes creation and/or maintenance of an elastohydrodynamic lubrication film between the stem and the surrounding guide surface.

What is claimed is:

1. An internal combustion engine valve having a stem having a plurality of circumferentially spaced marks in the outer surface thereof for a predetermined axial length therealong and respectively oriented at an acute angle with respect to a central longitudinal axis of the stem, said marks operative to promote stress planes in the stem that are effective to lessen stress arising from bending and reciprocating tensile forces acting upon the stem in a direction substantially parallel to said axis and to enable maintenance of an elastohydrodynamic lubrication film between the stem and a surrounding surface of a guide in which the stem reciprocates during operation of the engine.

2. The valve of claim 1 having two sets of the marks that respectively intersect each other to provide a cross-hatch pattern.

3. An internal combustion engine valve having a stem having a plurality of marks spaced circumferentially in the outer surface thereof for a predetermined axial length therealong and respectively oriented in a direction substantially parallel to a central longitudinal axis of the stem, said marks effective to reduce surface area thereof engageable with a surrounding surface of a guide through which the valve stem reciprocates during operation of the engine and to enable maintenance of an elastohydrodynamic lubrication film therebetween.

* * * * *